US010967418B2

(12) United States Patent
Otto et al.

(10) Patent No.: US 10,967,418 B2
(45) Date of Patent: Apr. 6, 2021

(54) SHAPING DEVICE, IN PARTICULAR A SPINDLE PRESS, AND METHOD FOR SHAPING WORKPIECES

(71) Applicants: Langenstein & Schemann GmbH, Coburg (DE); Eleonore Hausdörfer, Mitwitz (DE)

(72) Inventors: Markus Otto, Lautertal (DE); Kai Krzyzanowski, Coburg (DE); Siegfried Hausdoerfer, Mitwitz (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 228 days.

(21) Appl. No.: 15/766,344

(22) PCT Filed: Sep. 8, 2016

(86) PCT No.: PCT/EP2016/071192
§ 371 (c)(1),
(2) Date: Apr. 5, 2018

(87) PCT Pub. No.: WO2017/060029
PCT Pub. Date: Apr. 13, 2017

(65) Prior Publication Data

US 2018/0290201 A1 Oct. 11, 2018

(30) Foreign Application Priority Data

Oct. 6, 2015 (DE) ..... 102015116974.6

(51) Int. Cl.
*B21J 9/02* (2006.01)
*B21J 9/18* (2006.01)
(Continued)

(52) U.S. Cl.
CPC . *B21J 9/18* (2013.01); *B21J 7/32* (2013.01); *B21J 13/08* (2013.01); *B30B 1/181* (2013.01); *B21J 13/085* (2013.01); *B21J 13/14* (2013.01)

(58) Field of Classification Search
CPC ..... B21D 43/14; B21D 43/145; B21D 43/02; B21D 43/026; B21D 43/04; B21J 13/08;
(Continued)

(56) References Cited

U.S. PATENT DOCUMENTS 2,390,600 A * 12/1945 MacPheat ..... B21D 43/14 72/419
3,061,913 A * 11/1962 Schenk, Jr. ..... B21D 43/14 29/823
(Continued)

FOREIGN PATENT DOCUMENTS

CN 201186499 Y 1/2009
CN 101817052 A 9/2010
(Continued)

OTHER PUBLICATIONS

Office Action for China application No. 201680071202.2 dated Dec. 3, 2019.
(Continued)

*Primary Examiner* — Adam J Eiseman
*Assistant Examiner* — Dylan Schommer
(74) *Attorney, Agent, or Firm* — Workman Nydegger

(57) ABSTRACT

A forming device, (e.g., a spindle press), can include a processing head, having a processing tool that is guided along a movement axis for the forming processing of a workpiece, and a processing region, located opposite the processing head, a processing station configured for the forming processing of the workpiece, and a rotary table having an axis of rotation parallel to the direction of movement and workpiece receptacles that are arranged, with
(Continued)

respect to the axis of rotation, in an offset manner with respect to one another in the circumferential direction. The rotary table is configured such that each of the workpiece receptacles is transferable into at least one first working position located within the processing region and into at least one, second working position at least partially laterally outside a cross-sectional area of the processing head in axial projection with respect to the axis of movement.

26 Claims, 7 Drawing Sheets

(51) Int. Cl.

| | |
|---|---|
| ***B21J 7/32*** | (2006.01) |
| ***B21J 13/08*** | (2006.01) |
| ***B30B 1/18*** | (2006.01) |
| *B21J 13/14* | (2006.01) |

(58) Field of Classification Search
CPC ..... B21J 13/085; B21J 13/14; B30B 11/08; B29C 33/70
USPC ..... 100/223; 72/454; 425/345
See application file for complete search history.

(56) References Cited

U.S. PATENT DOCUMENTS

| | | | | | |
|---|---|---|---|---|---|
| 3,956,516 | A * | 5/1976 | Holt | A22C 7/0076 | 426/420 |
| 4,286,454 | A * | 9/1981 | Bachmann | B21J 9/02 | 470/140 |
| 4,287,748 | A * | 9/1981 | Wolfthal | B21D 43/05 | 29/38 C |
| 4,782,749 | A * | 11/1988 | Iwasaki | B30B 1/23 | 100/271 |
| 5,095,731 | A | 3/1992 | Greslin | | |
| 2003/0167938 | A1 | 9/2003 | Olsson | | |

FOREIGN PATENT DOCUMENTS

| | | | | |
|---|---|---|---|---|
| CN | 101941299 | A | 1/2011 | |
| CN | 202824313 | U | 3/2013 | |
| CN | 104070098 | A | 10/2014 | |
| DE | 883552 | C | 7/1953 | |
| DE | 1627688 | A1 | 5/1970 | |
| DE | 2532067 | A1 * | 2/1976 | B21J 9/02 |
| EP | 0764484 | A1 * | 3/1997 | B21K 1/466 |
| JP | H0819826 | A | 4/1997 | |
| RU | 2098215 | C1 | 12/1997 | |
| SU | 412020 | A1 | 1/1974 | |
| SU | 1310083 | A1 | 5/1987 | |

OTHER PUBLICATIONS

International Search Report for Patent Cooperation Treaty application No. PCT/EP2016/071192 dated Sep. 12, 2016.

"Doppeldruck-Kaltpressen HC MIT Rotierendem Matrizenhalter Zur Herstellung Von Schrauben, Nieten Und Anderen Formteilen", Draht, Meisenbach, Bamberg, DE, vol. 38, No. 3, Mar. 1, 1987 ISSN: 0012-5911.

Office Action for China application No. 201680071202.2 dated May 17, 2019.

International Preliminary Report on Patentability for Patent Cooperation Treaty No. PCT/EP2016/071192 dated Jan. 2015.

* cited by examiner

SHAPING DEVICE, IN PARTICULAR A SPINDLE PRESS, AND METHOD FOR SHAPING WORKPIECES

CROSS-REFERENCE TO RELATED APPLICATIONS

The present invention is a 35 U.S.C. § 371 U.S. National Stage Application corresponding to PCT Application no. PCT/EP2016/071192, filed on Sep. 8, 2016, which claims the benefit of priority to German Patent Application No. DE 10 2015 116 974.6 filed Oct. 6, 2015. The entire content of each of the aforementioned patent applications is incorporated herein by reference.

BACKGROUND OF THE INVENTION

1. Field of the Invention

The invention relates to a forming device, in particular a spindle press, for the forming processing of workpieces, and to a method for the forming processing of workpieces using such a device.

2. Background

For the forming of workpieces, striking forming machines, such as hammers and spindle presses, in particular flywheel spindle presses, are known. Reference is made for example to DE 78 22 648 U1, from which a spindle press for forging a shaft flange is known, wherein a rotary table which is configured with lower dies for receiving workpieces and has different approach positions is arranged in an aligned manner beneath a die plate that is attached to a slide and has a plurality of upper dies.

BRIEF SUMMARY OF THE INVENTION

In such spindle presses, the forming energy required for workpiece forming can be generated via a spindle and a striking tool, or a slide, and transmitted to the workpiece. The spindle can be driven in a motorized manner directly by a motor or by a flywheel connected in a form- or force-fitting manner. The rotary movement of the spindle is converted into a rectilinear slide movement via a steep multi-start thread. When the slide meets the workpiece with impact, the kinetic energy of flywheel, spindle and slide is converted fully into useful work and energy loss. The drive used for the spindle or the flywheel is generally an electric drive motor. With a rotary table, as known for example from DE 78 22 648 U1, workpieces can be rotated between different approach positions within the processing region of the upper die.

Proceeding therefrom, it is an object of the invention to specify a novel forming device, in particular a spindle press, and a novel method for forming a workpiece, which allow in particular improved workpiece guiding and, optionally, an improved workpiece throughout.

This object is achieved by a forming device and a method for the forming processing of a workpiece as claimed in the independent claims. Advantageous configurations and developments can be gathered in particular from the dependent claims, and from the following description.

According to a configuration of the invention as claimed, a forming device, for example in the form of a spindle press, is proposed, which comprises a processing head that is mounted or guided in a movable manner along an axis of movement for the forming processing of at least one workpiece, said processing head having at least one processing tool.

The processing head can be configured in a manner attached for example to a slide or ram of the forming device or in a manner integrated therewith. The processing head can comprise for example a die plate which can be configured to hold the at least one processing tool thereon, for example in a releasable manner. The axis of movement can be for example collinear with the trajectory, i.e. the central axis of movement, resulting during operation of the forming device, of the processing head or of a slide or ram coupled thereto.

The proposed forming device furthermore comprises a processing region, located opposite the processing head, having at least one processing station configured for receiving and for the forming processing of the workpiece.

The proposed forming device of the configuration as claimed in claim 1 furthermore comprises a rotary table having an axis of rotation (truly) parallel to the direction of movement. The rotary table also comprises workpiece receptacles that are arranged, with respect to the axis of rotation, in an offset manner with respect to one another in the circumferential direction. Overall, it is possible for several, for example three, four or more, workpiece receptacles to be provided on the rotary table along a circular line in the circumferential direction.

According to the configuration of claim 1, the rotary table is configured, or arranged, and mounted in a rotatable manner such that, as a result of the rotary table being rotated about the axis of rotation, it is possible to transfer each of the workpiece receptacles into at least one first working position located within the processing region. As a result of one of the workpiece receptacles being transferred into a first working position and subsequent operation or subsequent activation of the processing head, the workpiece located in the respective first working position can be formed.

Furthermore the rotary table of the configuration of claim 1 is configured, or arranged, and mounted in a rotatable manner such that, as a result of the rotary table being rotated about the axis of rotation, it is possible for each of the workpiece receptacles to be transferred into at least one, second working position which is located at least partially laterally outside a or the cross-sectional area of the processing head in axial projection with respect to the axis of movement. In this case, the rotary table and the processing head can be arranged and mounted with respect to one another such that, as seen in axial projection parallel to the axis of movement of the processing head, the second working position(s) are located such that a workpiece receptacle located in a respective second working position is arranged at least partially outside the cross-sectional area in a direction transverse to the axis of movement. For example, the arrangement of rotary table and processing head and the configuration thereof can be implemented such that a central axis or a fitting opening configured to feed and/or hold a workpiece at the workpiece receptacle is located laterally outside the cross-sectional area.

The cross-sectional area can be for example the or a minimum cross-sectional area of the processing head and/or of a slide or ram coupled thereto, and/or the cross-sectional area can be given by the cross section of the processing head and/or slide or ram, at that end of the processing head, slide or ram that faces the processing region.

The axis of movement can extend for example parallel to the vertical direction, this meaning in particular that the processing head, and optionally a slide or ram connected or coupled thereto, can be attached and arranged so as to be movable up and down, for example with regard to an upper crosshead.

If the forming device is configured as a spindle press with a slide, the slide can be arranged so as to be movable back and forth, for example periodically, in the axial direction thereof, i.e. along the axis of movement, wherein it can be driven or moved by a spindle in the axial direction. Via the spindle, in particular a threaded spindle, which can in turn be driven by a suitable actuator, for example a motor or a motor coupled to a flywheel, forming energy can be transmitted to a workpiece via the processing tools, in particular in cooperation with corresponding counterpart tools of the workpiece receptacles.

When the processing head, i.e. the processing tools, meets the workpiece, in particular with impact, kinetic energy of the processing tools of the processing head and/or of the slide or of a ram can be converted into useful work and energy loss for forming the workpiece.

The processing region, in particular the footprint thereof, can be in the form of a circular ring segment or of a circular segment with a center angle of at least 180°, preferably a center angle of more than 180°, for example more than 270°. Accordingly, the first working position(s) can be located within such a circular ring segment. The second working position(s) can be located within a circular ring segment or a circular segment with a center angle of less than 180°, for example less than 90°.

In configurations with several processing tools, it is possible, if the forming device is configured as a spindle press, for the processing tools to be formed symmetrically with respect to a central plane, parallel to the axis of movement, of the spindle of the spindle press. For example, it is possible for two processing tools to be arranged or to be able to be arranged such that, as seen in axial projection, the axis connecting the centers of two, in particular adjacent, processing tools or processing tool receptacles extends through the center of the spindle circle defined by the outer circumference of the spindle in axial projection. In such configurations, but also in other configurations described herein, the axis of rotation of the rotary table can be located laterally outside the spindle circle as seen in axial projection with respect to the axis of movement.

In configurations, the forming device can be configured as a spindle press having a spindle and a slide coupled thereto, wherein the processing head can be formed on or attached to the slide. The at least one second working position can, in such configurations, be located at least partially laterally outside a cross-sectional area of the slide with respect to the axis of movement as seen in axial projection. The cross-sectional area of the slide can be for example a cross-sectional area which is defined by the dimensions of the slide at the end facing the processing region.

In further configurations, provision can be made for the axis of rotation of the rotary table to be spaced apart, in a direction transversely to the axis of rotation, from a slide axis, or spindle axis, extending parallel to the axis of movement.

An offset or spacing between the axis of rotation of the rotary table and the, in particular central, axis of movement, the slide axis and/or spindle axis, can be for example between 360 mm and 375 mm, wherein, in configurations, a spindle diameter of the spindle can be 600 mm, and a diameter of the rotary table can be about 1400 mm.

In configurations, provision can be made for the spindle axis or slide axis to be located, as seen in axial projection, within that circular line on which the centers of the workpiece receptacles of the rotary table are located. In other words, provision can be made, in configurations, for the spacing between the axis of rotation and centers of the workpiece receptacles to be greater than the spacing between the axis of rotation and the slide axis and/or spindle axis. A spacing between the circular line and the spindle axis or slide axis can lie for example in the range between 50 mm and 65 mm, in particular around 57 mm.

In configurations, provision can be made for exactly three workpiece receptacles to be formed on the rotary table, and for exactly four forming positions or stations to be formed on the processing head or slide in a manner facing the workpiece receptacles.

The workpiece receptacles and processing or forming stations can be set up such that central axes (or: longitudinal axes), extending parallel to the axis of movement, in particular the slide axis, of the processing stations or processing tools intersect a circular line defined by the axes or central axes of the workpiece receptacles.

In configurations, in particular according to one of the preceding or following configurations, the workpiece receptacles can be arranged on the rotary table of the forming device along a circular line, i.e. in a circular manner with respect to the axis of rotation $M_D$, and can be at defined angular spacings from one another with respect to the axis of rotation of the rotary table, wherein an angular spacing between two directly adjacent workpiece receptacles can be for example 60 degrees, 90 degrees or 120 degrees, and wherein the angular spacings can optionally be selected such that the workpiece receptacles are arranged in a uniformly distributed manner along the circular line.

In variants, it is possible for example for the axes or central axes, extending parallel to the axis of rotation of the rotary table, of four processing stations to be located on one half or a semicircle of the circular line. Two of the central axes can for example intersect the center line of the circular line, and two others of the central axes can intersect a secant of the circular line.

In configurations, in the proposed arrangement of the rotary table, an axis of rotation of the rotary table, about which the latter is mounted on the forming device in a rotatable manner, can be arranged in a manner offset parallel to the central axis of the slide and/or in a manner offset parallel to the central axis, extending in the axial direction, of the processing head. It should be noted at this point that the central axis of the slide and the central axis of the processing head do not absolutely have to be formed in a manner aligned with one another. In particular, in both cases mentioned, according to one of the solutions proposed herein, the axis of rotation of the rotary table can be set up and positioned such that a workpiece receptacle is transferable into a first working position located in the area of coverage or area of action of the axial projection of the processing head and/or of the slide, and such that, as a result of the rotary table being rotated, the workpiece receptacle is transferable into a second working position that is different than the first and located outside, in particular outside the area of coverage or area of action, of the processing region.

In variants, the rotary table can be configured in a disk-like manner, in particular with an axis of rotation arranged in a manner offset radially with respect to the longitudinal axis of the slide and/or of the processing head. In configurations, provision can be made for a radius of curvature of the rotary table to be greater than, for example at least twice as large as, the cross-sectional radius of the slide and/or of the processing head and/or of the spindle.

In variants, it is possible for the rotary table to be attached, for example to a forming table, so as to be mounted about an axis of rotation, such that the rotary table is located, in particular with respect to the axis of rotation thereof, eccentrically with respect to the processing region defined on the forming table by the slide and/or the processing head.

With the proposed rotary table arrangement, for example in the manner of a turret plate, it is advantageously possible to fit the workpiece receptacles in working positions outside the axial projection of the processing head and/or of the slide, and preferably outside the effective range of the processing head, or to carry out other actions thereon or therewith.

The processing head can have one or more upper dies for the forming processing of workpieces, wherein the upper dies can be provided on the processing head in a symmetrical arrangement to one another. For example, the upper dies can be arranged along a circular arc and/or be located within a circular ring segment.

The rotary table can have one or more workpiece receptacles, for example lower dies. The workpiece receptacles or lower dies, in particular the centers thereof, can be arranged on the rotary table for example along a circular line, as seen in axial projection with respect to the axis of movement. In configurations, provision can furthermore be made for a circular arc defined, as seen in axial projection, by the processing tools, for example upper dies, present on the processing head, to coincide at least partially, for example along a circular arc with a center angle of greater than 180°, or greater than 270°, with the circular line defined by the workpiece receptacles.

In configurations, provision can be made for the processing region, as seen in axial projection with respect to the axis of movement, to be substantially congruent with the cross-sectional area of the processing head and/or slide. In the case of a spindle press, the processing region can be defined in terms of its dimensions for example by the circle diameter of the spindle and/or of the slide and/or processing head. The processing region, in particular the extent of the processing region, can be set or defined for example by the axial projection of the slide circumference and/or of the processing head circumference and/or of the spindle circle circumference. In configurations, the processing head circumference can, as seen in axial projection with respect to the axis of movement, be located completely within the slide circumference or be congruent therewith.

In particular in configurations as mentioned above, it is possible for the at least one second working position to be located outside the effective range or effective volume or stroke range or stroke volume taken up by the axial movement of the slide or processing head. In particular, it is possible in such case for workpieces in the second working position to be fed comparatively easily and to be removed comparatively easily from the rotary table, without being impaired by any axial movements and moved masses of slide and/or processing head.

In configurations, provision can be made for the spindle diameter and/or slide diameter, measured transversely to the axis of movement, and/or the processing head diameter to be smaller than or at most the same as the radius or diameter of the rotary table.

In configurations, provision can be made for the processing head, or for example the slide if the processing head and slide have been fused to form one structural unit, to comprise at least one processing tool, in particular upper die, and for the at least one of the workpiece receptacles to comprise a lower die which, during operation of the forming device, is able to be cooperatively coupled to the upper die in the first working position.

In configurations with several processing tools, for example upper dies, on the processing head and optionally further tools, for example lower dies, assigned respectively to the workpiece receptacles, the centers of the processing tools and of the further tools can lie on a common path, in particular a circular path, as seen in axial projection with respect to the axis of movement.

An angular spacing, measured with respect to the axial direction, between two directly adjacent upper dies, optionally lower dies, or workpiece receptacles can lie for example, and in particular in each case, in the range between 30 degrees and 120 degrees, and be in particular 30 degrees, 60 degrees or for example 90 degrees.

In configurations, provision can be made for the angular spacing between adjacent processing tools, for example upper dies, to be an integer fraction of the angular spacing between adjacent workpiece receptacles, for example lower dies. In other words, the angular spacing between two directly adjacent workpiece receptacles on the rotary table can be an integer multiple of the angular spacing between two adjacent processing tools on the processing head. Preferably, the processing tools and/or workpiece receptacles are arranged in a uniformly distributed manner, with in each case equal angular spacings between one another. For example, the angular spacing between directly adjacent workpiece receptacles on the rotary table can be 120 degrees, and an angular spacing between directly adjacent processing tools on the processing head can be 60 degrees.

In configurations, provision can be made for at least one of the at least one second working position to be provided and configured to carry out maintenance measures on a workpiece receptacle located in the one second working position, for example on a corresponding tool, for example lower die.

In further configurations, the forming device can comprise a maintenance device configured to carry out at least one corresponding maintenance measure, wherein the maintenance device can be configured for example to carry out lubrication, cleaning and/or cooling on the respective workpiece receptacle, for example on a corresponding tool, in particular lower die.

In further variants of the configurations described above and below or in accordance with a further aspect of the invention described herein, which can in particular also be claimed independently of a rotary table arrangement, i.e. also in forming devices without a rotary table or in forming devices with tables configured for linear displacement or carriages, provision can be made for the forming device to comprise at least one axial drive or at least one lifting unit, which is configured to displace the rotary table, or more generally a or the forming table, the forming device and/or at least one workpiece receptacle or corresponding tool, in particular lower die, and/or at least one tool coupled to the workpiece receptacle, and/or at least one workpiece located in a tool, in particular lower die, of the rotary table, parallel to the axis of movement of the processing head of the forming device.

In configurations, the axial drive or the lifting unit can be installed or mounted for example at least partially on or in a forming table, on or in a rotary table receptacle configured for mounting the rotary table on the forming table, and/or on or in the rotary table. The axial drive or the lifting unit can comprise for example at least one, for example motor-driven, drive slide which is mounted so as to be movable in a reciprocating manner and by way of which the rotary table, the workpiece receptacle, the tool and/or the workpiece is movable parallel to the axis of movement. In the case of a vertical forming machine with a vertically moved processing head, the axial drive can be configured such that a workpiece located in a workpiece receptacle is lifted and/or lowered for example in individual processing stations with respect to the workpiece receptacle or a corresponding lower die or with respect to the rotary table. For example, the axial drive can be configured to provide the workpiece in a lowered state in one working position, and to provide it in a lifted state in another, for example subsequent, working position.

Such an axial drive makes it possible to lift the rotary table, the workpiece receptacle and/or a workpiece during, before or after a forming step and/or during the displacement or rotation of the rotary table between different working positions.

Lifting, for example during the change of working position, can be used for example to reduce the friction, which occurs during rotation, between components that are moved with respect to one another, for example between the rotary table and forming table. A corresponding stroke of the axial drive, in particular of a drive slide, ejector rod or slide or lifting rod or slide of the axial drive, can be for example in the region of about 2 mm.

In configurations, provision can be made for the drive slide(s) of the axial drive to be present in the forming table, in or on which the rotary table is mounted in a rotatable manner, in at least one first and/or second working position. The drive slide can be mounted in the forming table in a longitudinally displaceable manner, for example parallel to the axis of movement of the processing head or to the axis of rotation of the rotary table. The rotary table, in particular the workpiece receptacles thereof, can be configured such that these have, on the side facing the rotary table, one or more apertures through which, upon positioning in a working position equipped with a drive slide, the drive slides can be moved or can engage, in order in this way to be able to move the corresponding workpiece relative to the rotary table or the workpiece receptacle.

In configurations, the axial drive can also be configured such that, in at least one working position, the drive slide is lowered in relation to further working positions, such that, during a forming operation assigned to the working position, it is possible for the workpiece material to expand in the direction of the lowered drive slide. The drive slide can, in such configurations, be arranged and configured for example such that it can be recessed with respect to a workpiece support level, for example in the forming table, wherein the workpiece support level can be formed by a support surface formed between the forming table and rotary table. After corresponding forming and associated expansion of the workpiece material in the direction of the drive slide, the latter can be moved in the direction of the rotary table, in order in this way to lift the workpiece such that the rotary table can be rotated further and/or for the purpose of a subsequent removal of the workpiece from the workpiece receptacle.

The axial drive can be configured and set up for example such that it can move a workpiece located in the respective working position relative to the rotary table, in particular lift it or lift it off the workpiece receptacle, and/or move it in the workpiece receptacle. For example, the axial drive can be configured such that, in at least one working position, a workpiece can be moved parallel to and/or in the opposite direction to the forming movement of the slide. Further configurations and variants of the axial drive can be gathered in particular from the described, given further below, of exemplary embodiments in conjunction with the appended figures.

In configurations, provision can be made for the forming device furthermore to comprise a forming table assigned to the processing region, wherein the rotary table can be fastened to the forming table by means of an adapter unit or adapter. The adapter unit can be configured, and be able to be coupled to the forming table and the rotary table, such that the axis of rotation of the rotary table is arranged in a manner spaced apart from the axis of movement, i.e. from the central axis of movement of the processing head, i.e. the rotary table can be arranged eccentrically with respect to the axis of movement. Using such an adapter, it is possible for example to equip or retrofit conventional forming plants with a rotary table arrangement as proposed herein.

In configurations, the rotary table can be arranged on the forming table, for example on a tabletop or bearing plate, so as to be mounted in a sliding manner. A unit formed from the rotary table and tabletop or bearing plate can in turn be fastened to an associated forming or press table, for example by means of screws.

In configurations, the forming device, as already mentioned, can be a spindle press having a spindle configured to drive the processing head. At least one processing tool of the processing head can in this case have a central axis extending parallel to the axis of movement of the processing head, said central axis being located, as seen in axial projection, lateral within, at the edge or immediately adjacent to the spindle cross-sectional area. Furthermore, it is possible, alternatively or in addition, for, as seen in axial projection, an axis connecting the centers of two, in particular adjacent, processing tools or processing tool receptacles of the processing head to extend through the center of the spindle circle defined in axial projection by the outer circumference of the spindle.

As claimed in claim 11, a method for the forming processing of a workpiece using the above-described forming device is provided. The proposed method comprises in particular the following steps of:

a) transferring one of the workpiece receptacles of the rotary table into one of the at least one second working position, located laterally outside the cross-sectional area of the processing head, by rotating the rotary table about its axis of rotation;
b) inserting the workpiece into the workpiece receptacle located in the second working position;
c) rotating the rotary table about its axis of rotation such that the workpiece is transferred from the second working position into one of the at least one first working positions;
d) activating the processing head for the forming processing of the workpiece;
e) optionally rotating the rotary table about its axis of rotation and transferring the workpiece into a further first working position;
f) transferring the workpiece into the second working position, or into a further second working position located laterally outside the cross-sectional area of the processing head; and
g) removing the workpiece from the workpiece receptacle located in the second or further second working position.

For advantages and advantageous effects of the method, reference is made to the statements given for the forming device, which apply in a corresponding manner.

Both the insertion of the workpiece and the removal of the workpiece after forming can take place at second working positions, i.e. at working positions outside the working region of the slide and of the upper dies. Apart from that, a further second working position, i.e. a working position located outside the processing region, can be provided, which is configured and provided for carrying out die maintenance measures such as lubrication, cooling and/or cleaning.

In configurations, in particular of the method, provision can be made for the rotary table to be rotated synchronously with the activation or deactivation of the processing head, preferably through in each case an integer fraction of a full angle, and wherein the direction of rotation of the rotary table during the processing cycle of the workpiece is preferably reversed at least once.

In configurations, in particular of the method, provision can be made for the rotary table and/or at least one workpiece receptacle together with the workpiece to be lifted or lowered parallel to the axis of movement of the processing head or axis of rotation of the rotary table during at least one processing step and/or at least between two processing steps. In this way, it is possible, inter alia, to reduce the contact time between the workpiece and tool, in order for example to reduce the heat input into the tool. For further advantages, reference is made to the statements further above.

In configurations, in particular of the method, provision can be made for the workpiece receptacles to be arranged, with respect to the axis of rotation, in a manner offset through an angle of 120 degrees with respect to one another, and a workpiece receptacle fitted with a workpiece is transferred, starting from the second working position for the forming processing of the workpiece, successively into a plurality of first working positions that are arranged, with respect to the axis of rotation, in a manner offset through an angle with respect to one another. For example, four first working positions that are arranged in an offset manner with respect to one another can be passed through in accordance with a movement pattern, according to which, starting from the or a second working position, by rotating the rotary table, the workpiece receptacle is rotated, in plan view of the rotary table, first of all through +60 degrees, i.e., in axial plan view of the rotary table from above, through an angle of 60 degrees counterclockwise, and subsequently rotations through +180 degrees or −180 degrees, −120 degrees and +60 degrees are carried out. The workpiece can be transferred back into the second working position for removing the workpiece by a further, subsequent rotation through an angle of −180 degrees or +180 degrees after processing has been completed.

Before a workpiece receptacle is fitted with a further workpiece after a preceding removal step, it is possible for example for a rotation through an angle of 120 degrees to be carried out, such that a lower die that has been emptied immediately beforehand remains unoccupied, and is available for example for die maintenance measures such as cooling, lubrication, cleaning, etc.

In configurations of the method, provision can be made for one of the workpiece receptacles, in particular exactly one of the workpiece receptacles, to be unoccupied during a complete operating cycle for producing the workpiece, i.e. during an entire operating cycle comprising steps necessary for producing the workpiece, and in particular at least one, preferably exactly one, of the workpiece receptacles to always be unoccupied. In a state not occupied by a workpiece or blank intended for producing the workpiece, the workpiece receptacle can cool down, or maintenance measures can be carried out.

The processing tools and workpiece receptacles and also the rotation of the rotary table can, in the example of a forming device which comprises the four forming operations of i) first cone formation, ii) second cone formation, iii) preforming forging operation, and iv) finishing forging operation, be configured with corresponding four forming dies such that, in a first rotational position of the rotary plate, a preforming forging operation and insertion of a workpiece into a workpiece receptacle are possible, in a rotational position rotated through +60°, first cone formation, a finishing forging operation and optionally die maintenance are possible, and in a rotational position rotated through a further −180°, second cone formation and removal of a finished formed workpiece are possible. Then, the rotary table can be rotated through a further −120° and the described rotational positions can be passed through again.

In a corresponding configuration with four processing stations, i.e. four first working positions, for forming a workpiece, three workpiece receptacles can be arranged in a manner offset with respect to one another with an angular spacing of 120 degrees, wherein adjacent first working positions, corresponding to the position of the processing tools, can each be arranged for example in a manner offset through an angular spacing of 60 degrees with respect to one another.

In configurations, the forming device, for example a spindle press, can comprise a slide which can be coupled to a spindle and moved rectilinearly relative to a lower carrier, or tool table, by the spindle, in order in this way to transmit a forming force to at least one workpiece arranged on the rotary table. At the rotary table it is possible for a plurality of approach positions, i.e. workpiece receptacles or tool receptacles, to be present, for example on a circular path, in a manner offset in the circumferential direction with respect to one another, in each case at the same basic angle of rotation, it being possible for example for each of said approach positions to be fitted with a lower die for receiving a workpiece.

As already mentioned, the rotary table is mounted so as to be movable about an axis of rotation, wherein the axis of rotation can be located in a manner offset parallel to a slide axis, in particular a spindle axis in the case of a spindle press.

In configurations, the circular path can be arranged such that it is located with a part of a circular sector, or such that a circular arc of the circular path is located within a spindle circle defined by the spindle or by an axial projection of a spindle circle defined by the spindle. The circular arc in which the spindle circle is located can span for example an angle of less than 90 degrees, or for example less than 60 degrees.

In configurations, provision can be made for example for the rotary table to have three workpiece receptacles, for which six different approach positions are provided, wherein at least one, for example two, of the six approach positions can be configured as second working positions. The ratio of the number of workpiece receptacles and the number of approach positions can, as in the present example, be an integer, but non-integer ratios are also conceivable.

In configurations, provision can be made for at least two approach positions, i.e. two working positions, into which the workpiece receptacles can be brought by rotating the rotary table, to be configured as second working positions. Corresponding approach positions can be used for example for fitting or emptying and/or for die maintenance.

In variants of the method, provision can be made for at least one workpiece to be inserted into at least one lower die arranged on the rotary table, and for the rotary table to be moved about its axis of rotation such that the lower die carrying the workpiece is positioned in a first working position, wherein at least one further lower die is positioned in a second working position. After the workpiece has been positioned in the processing region by corresponding rotation of the rotary table, the respective workpiece can be processed, for example by carrying out an individual or a plurality of processing steps, in that for example with upper dies arranged on the slide, for example on an underside of the slide and/or on an underside of a processing head assigned to the slide. For processing, the slide can be moved in an axial, rectilinear movement toward the rotary table, such that the upper die can act on the workpiece located in the lower die, wherein, as a result of the combined action of upper die and lower die and as a result of the force action generated by the slide, the workpiece can for example be formed.

As a result of the arrangement of the workpiece receptacles, for example comprising lower dies, on the rotatably mounted rotary table, it is possible for high-quality processing of workpieces, both quantitatively and qualitatively, to be achieved. An offset, i.e. eccentric, arrangement of the axis of rotation of the rotary table and the spindle, slide and/or processing head with respect to the transversal makes it possible in particular for a workpiece to be processed to be able to be rotated into different working positions, including into at least one second working position, which can be used for example for fitting with and removing workpieces.

The processes described can be carried out, for example during a processing step or cycle, approximately parallel to one another in time, as required. For example, it is possible, while one workpiece is being processed or formed in a lower die by means of the force action of the slide, for a further workpiece to be removed from another workpiece receptacle in a second working position, or for another workpiece receptacle in a second working position to be newly fitted with a workpiece.

The number and arrangement of the working positions or approach positions, and thus in particular also the number and arrangement of the workpiece receptacles, for example lower dies, can be designed to be variable, wherein the rotary table can have for example corresponding receptacles for lower dies. In particular the eccentric arrangement, proposed herein, of the axis of rotation of the rotary table with respect to the processing region makes it possible for a lower die arranged on the rotary table, and thus a workpiece received therein, to be positioned, for example for a first processing or forming operation, in the region of a processing tool arranged in the slide center, for example in the region of the spindle circle in the case of a spindle press, i.e. in the center of the processing region, and, in another processing operation, for the workpiece to be positioned outside the slide center, for example outside the spindle circle in the case of a spindle press. In particular, given corresponding positioning of the working positions and processing tools, it is possible for forming operations which require comparatively high forming forces to be carried out in the region or vicinity of the slide center or of the spindle circle, while forming operations with comparatively low forming forces are located in regions further away from the slide center or the spindle circle.

Given that the rotary table is mounted in an offset manner with respect to the center of the processing region, there are many more possibilities for varying the movement curves that are able to be implemented by the tool and workpiece receptacles upon rotation of the rotary table. In particular, movement curves can be used which, compared with the diameter of the slide, or processing region, have a much greater radius of curvature, for example one that is greater by a factor of 2, than comparable rotary tables with an arrangement concentric with the respective processing head. In particular it is possible to linearize and straighten out the movement curve, such that the arrangement of a plurality of processing stations is also possible in a comparatively problem-free and area-optimized manner.

A further advantage of the external positioning, with respect to the processing region, of insertion position(s) for workpieces and/or the offset arrangement of the axis of rotation relative to the slide axis or axis of movement can also be considered that of it thus being possible for the rotary table, i.e. the tools and/or workpiece receptacles, to be able to be fitted with comparatively long raw parts without in the process butting against the slide and/or bringing about mechanical damage to the slide and/or without it being necessary in the process to intervene in the region of action of moving parts of the forming device.

The processing tools mentioned herein, for example upper dies, can be designed as per the shaping desired for the respective workpiece. For example, the upper dies can be configured as hollow cones or the like. It is also possible for an upper die to be configured as a manipulator for gripping the workpiece.

In configurations, provision can be made, as already indicated, for the upper dies to be arranged on a circular path on the slide or processing head, the curvature of said circular path corresponding to the curvature of the circular path, defined by the workpiece receptacles, on the rotary table.

For example, it is possible in this way for the lower dies with the inserted workpieces to be positioned exactly beneath an upper die, as per the desired processing step, for processing.

According to further configurations, it is possible for the slide or processing head to have several different upper dies, in order for it to be possible for example to realize different processing steps on workpieces inserted in the lower dies. With a suitable arrangement, in particular spacing, of upper dies and lower dies, with a suitable choice of size of the rotary table and the radius thereof, and/or a suitable choice of the angular spacing of the workpiece receptacles on the rotary table, it is optionally possible for processing steps, in particular forming steps, to be carried out at least partially parallel in time.

The axial drive, described further above, for the workpieces and/or tool or workpiece receptacles and/or the lifting device or unit for the rotary table, which can be formed in an integrated or separate manner, can comprise for example one or more lifting cylinders, which is/are set up such that the workpiece, the workpiece receptacle and/or the rotary table, for example together with the workpiece, can be lifted and lowered in an axial direction, for example parallel to the axis of movement of the processing head or of the slide. For example, it is possible, in configurations, for the hydraulic cylinder to lift the workpiece, the workpiece receptacle and/or the rotary table during transfer into another working position. A lift can be for example in the range of a few millimeters, for example about 2 mm, or a few centimeters.

In particular, provision can be made, in configurations of the method, for the rotary table and/or the workpiece receptacle together with the workpiece or only the workpiece to be lifted or lowered parallel to the axis of movement during at least one processing step and/or at least between two processing steps.

As a result of the rotary table being lifted, it is possible, during the rotation of the rotary table between different working positions or approach positions, to avoid or at least reduce abrasive rubbing contact, which otherwise occurs for example, with the tabletop located therebeneath. The same goes for the workpiece receptacles and/or workpieces.

Each workpiece receptacle of the rotary table can, in configurations, for example integrated into the forming table, be assigned for example a separate axial drive unit, such that workpieces can be lifted or lowered specifically in respective working positions. In particular, it is possible, in such configurations, for the axial drive to be activated or deactivated for example depending on the type of the respective working position and in particular independently of other working positions.

The lifting device can be set up for example such that it can be used independently of specific processing steps and/or approach positions.

In particular in the case of a forming step, it is possible, for example, for the axial drive and/or the lifting unit to be activated such that the workpiece, the workpiece holder and/or the rotary table is/are set down or rest(s) on a forming table, a baseplate or press plate of the forming device during the forming operation itself, such that the torques that otherwise act on the rotary table and the axis of rotation on account of the eccentric arrangement of the axis of rotation are at least reduced, and preferably avoided entirely.

In the case of the rotary table arrangement proposed herein, it is possible in particular for the rotary table to have such a number of workpiece receptacles that, during proper operation, in at least one processing step, at least one workpiece receptacle, in particular a lower die, is unoccupied or can remain unoccupied. It is possible for example for a maintenance operation, as already explained further above, to be carried out on the unoccupied workpiece receptacle.

The workpiece receptacles and forming positions can be selected for example such that, during each forging or forming operation, at least one of the workpiece receptacles is positioned outside the forging or forming region, in a second working position. In this way, it is comparatively easily possible for a finished forged workpiece to be removed or a blank to be inserted into a free workpiece receptacle, without a fitting or removing device used therefor, for example a robot arm, having to work in the immediate vicinity or within the range of movement of the slide.

In particular in the case of three workpiece receptacles and four forming positions or stations, it is possible for a corresponding configuration, in which one workpiece receptacle is always outside the working region of the slide in a second working position, to be achieved in that for example the length of the circular line of the rotary table, on which the workpiece receptacles are located, is for example ⅙ to ⅓, in particular ¼ to ⅓, greater than the circular arc of this circular line that is covered by the cross-sectional area of the processing head, or by the processing region or working region of the slide.

An unoccupied workpiece receptacle or an unoccupied lower die can be for example cleaned, cooled etc. in the unoccupied state. For example, following the removal of a workpiece from a lower die, die maintenance, for example cooling or lubrication, can be realized thereon, with the result that the wear to the tool can be minimized and/or the production quality can be improved.

The invention is explained in more detail in the following text, also with regard to further features and advantages, by way of the description of exemplary embodiments and with reference to the accompanying drawings, in which

Mutually corresponding parts and components in FIG. 1 to FIG. 14 are denoted by the same reference signs. In the following text, reference is made to a forming device configured as a spindle press, wherein configurations of the following exemplary embodiments can also be applied to other types of forming devices. In particular, the following description of the invention is not intended to be understood as limiting to the area of spindle presses.

Figure 14:
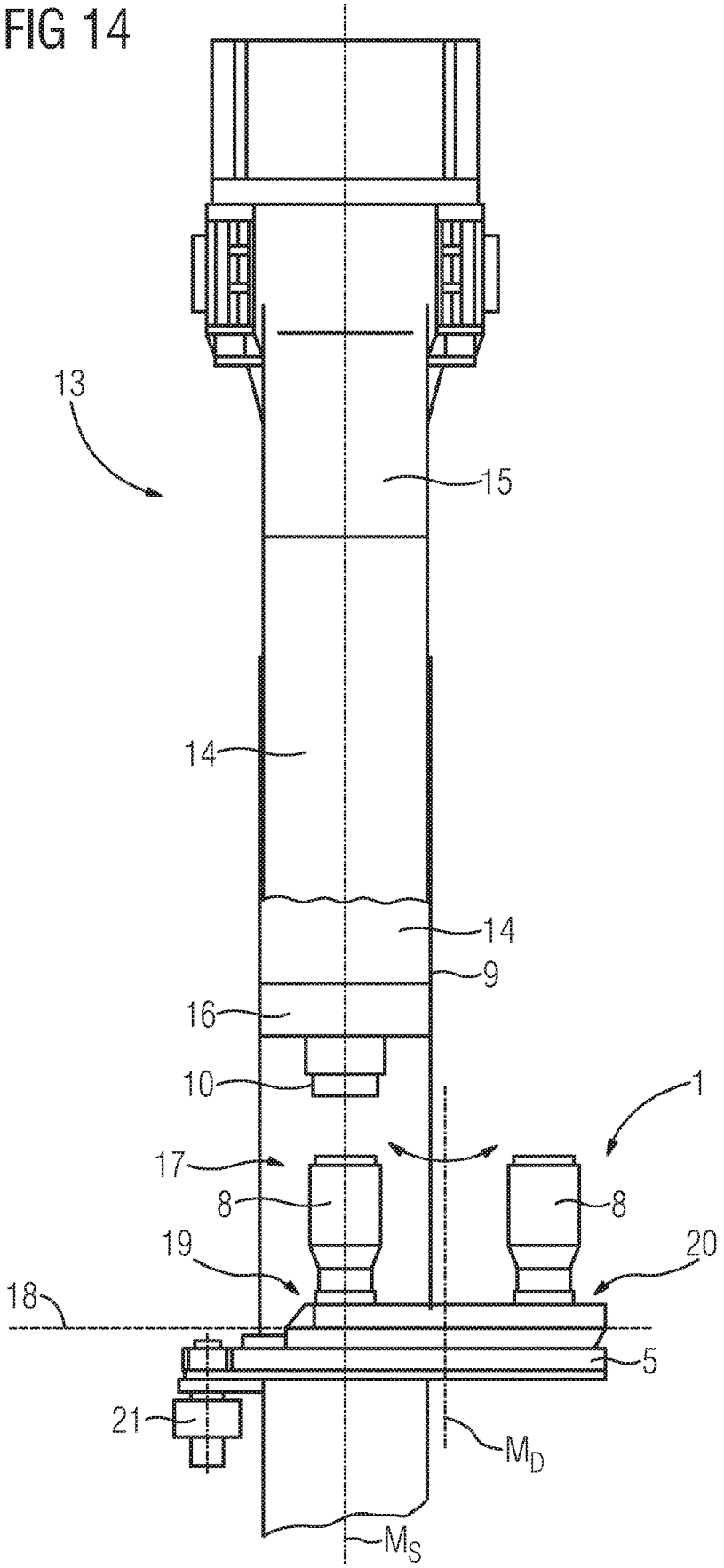
FIG. 14 shows a schematic view of a spindle press according to the invention.

As is apparent in particular from FIG. 14, the spindle press 13 comprises a slide 9 mounted on a frame 14 and crosshead 15 in a motor-driven manner for carrying out an up and down movement, a processing head 16 having at least one upper tool holder 10 being arranged on or fastened to the underside of said slide 9.

Located in axial projection beneath the processing head 16 or the slide 9, the diameter and transverse extent of which is approximately the same in the present case, is the processing region 17 of the spindle press 13.

The spindle press 13 furthermore comprises a rotary table 1 arranged shown), present beneath the slide 9 or beneath a spindle (not shown) for driving the slide 9 on a lower forming table or carrier 5, for example a tabletop. The rotary table 1 can be arranged on the tabletop for example so as to be mounted in a sliding manner.

The rotary table 1 is mounted so as to be rotatable about an axis of rotation $M_D$, wherein the axis of rotation $M_D$ is offset transversely with respect to a spindle axis $M_S$ of the spindle present for driving the slide 9, i.e. spaced apart from the spindle axis $M_S$ transversely to the axial direction of the latter. In the present case, the spindle axis $M_S$ coincides with the axis of movement of the processing head 16.

As a result of this axis of rotation $M_D$ offset in parallel, the rotary table 1 is set up and mounted in a rotatable manner in a transverse plane 18 such that each of the workpiece receptacles 8, i.e. each lower die 8 arranged on the rotary table 1, is transferable into a first working position 19 located within the processing region 17, and into at least one second working position 20 located outside the processing region 17 by rotating the rotary table 1.

The second working position(s) 20 is/are located laterally outside the cross-sectional area Q of the processing head 16 in axial projection with respect to the axis of movement $M_S$, wherein the cross-sectional area Q of the processing head 16, as in the example shown, can be congruent with the cross-sectional area Q of the slide 9. The first working position(s) 19 are arranged within the cross-sectional area Q as seen in axial projection.

In order to drive the rotary table 1, in particular in a synchronized manner with the up and down movement of the slide 9, for example for rotating the rotary table 1 in a movement in a clockwise or counterclockwise direction, a drive unit 21 is coupled to the rotary table 1. The drive unit 21 can furthermore have a lifting unit (see FIG. 5 to FIG. 7), with which the rotary table 1 and/or the lower dies 8 and/or the workpieces 11 located in the lower dies can be lifted and lowered in an axial direction.

DETAILED DESCRIPTION OF THE PREFERRED EMBODIMENTS

Figure 1:
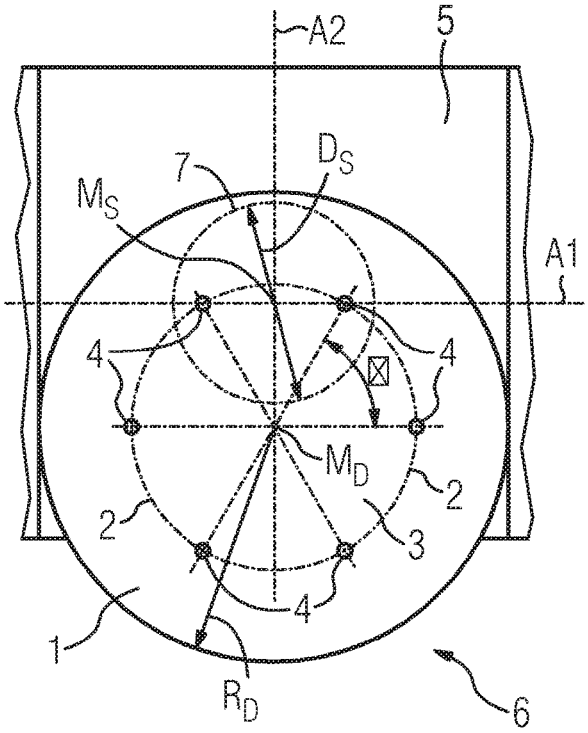
FIG. 1 shows a plan view of a rotary table according to the invention.

FIG. 1 shows a plan view of the rotary table 1, arranged in a rotatable manner on the lower carrier 5, for example a forming table or a press plate, as a constituent part of the forming machine 13, in particular spindle press.

Indicated within the region of the rotary table 1 is a circular path 2, on which a plurality of approach positions 4, or working positions, are provided, which can be approached along the circular path 2 by way of a rotary movement of the rotary table 1.

The circular path 2 is moreover subdivided into a plurality of circular sectors 3 of identical size, which are defined by a basic angle of rotation $\alpha$. These indicate at the same time the spacing or opening angle between the different approach positions 4 which are arranged at the respective ends of the circular arc of the circular sectors 3. The value of the basic angle of rotation $\alpha$ can be matched to the respectively required number of approach positions 4, for example 60 degrees, or 90 degrees or 120 degrees.

Figure 2:
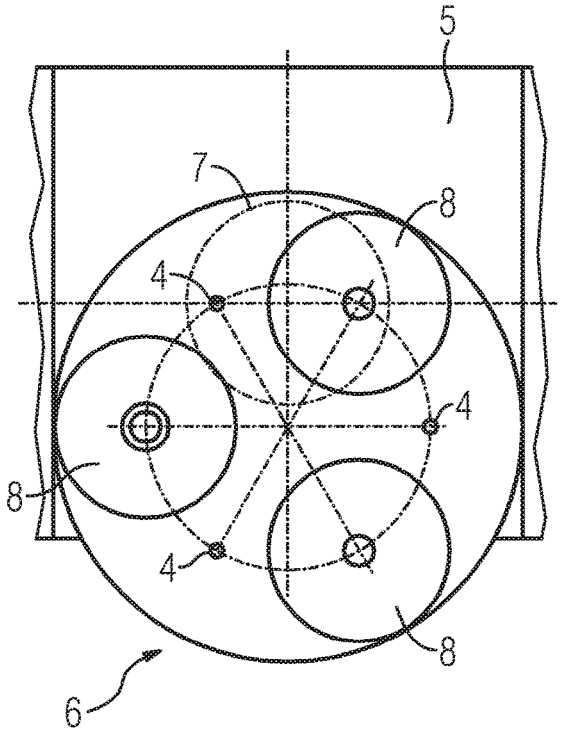
FIG. 2 shows a further plan view of the rotary table according to FIG. 1.

FIG. 2 shows the same illustration of the rotary table 1 with an example of the occupation with lower dies 8, or workpiece receptacles, on the rotary table 1. The lower dies 8 are intended to be loaded or fitted with workpieces 11 (illustrated in FIG. 4) and to be transported to an intended approach position 4 in order to be able to process the workpieces 11, for example in the processing region 18, in cooperation with the slide 9, or upper die 22, for example for the purposes of forming the workpieces 11.

Figure 3:
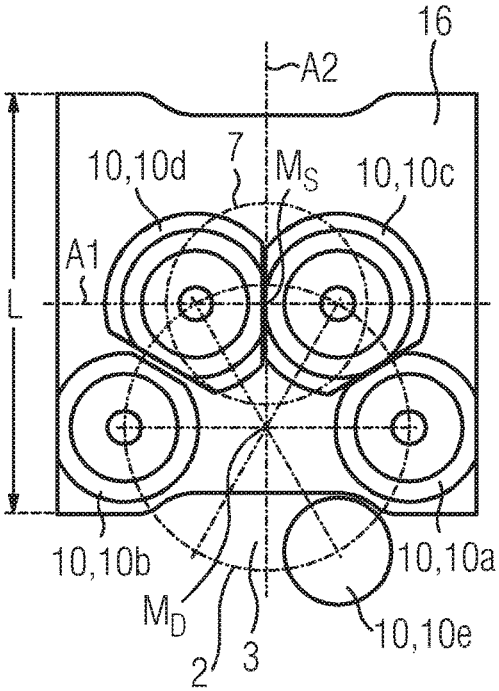
FIG. 3 shows a plan view of a slide.

FIG. 3 shows a plan view of a processing head 16, which, for example by being coupled to a spindle (not illustrated), can be moved rectilinearly along the axis of movement $M_S$ relative to the lower carrier 5 in order to process a workpiece 11. The 9-processing head 16 is not limited to the shaping shown and can also be configured for example in a round manner.

The illustration of the spindle, or slide 9, and of the processing region 17 is limited in the exemplary embodiment to a circular area, indicated here by a spindle circle 7, which corresponds to the diameter of the spindle, or the projection thereof, wherein the spindle axis $M_S$ coincides with the intersection of the slide axes A1 and A2, extending transversely to the axis of movement, of the slide 9. The centers of the slide 9 and of the spindle, or of the spindle circle 7, thus coincide in the present example.

The circular path 2 extends around an axis of rotation $M_D$ of the rotary table 1, which is arranged in a manner offset parallel to the spindle axis $M_S$, such that at least one circular segment of a circular sector 3 is always located within the spindle circle 7, in particular in the processing region 17, while at the same time the circular path 7, and thus at least one approach position 4, projects beyond the edge of the slide 9, in particular of the processing region 17.

The radius $R_D$ of the rotary table 1 is greater than, for example twice as large as, the diameter $D_S$ of the spindle and approximately the same size as or greater than half of a side length L of the processing head 16. The rotary table 1 can, as shown in FIG. 3, be arranged in particular eccentrically with respect to the spindle axis $M_S$, i.e. the spindle axis $M_S$ and the axis of rotation $M_D$ of the rotary table 1 can be spaced apart from one another.

As can be gathered in particular from FIGS. 1 and 2, the circular line 2 can be located on the rotary table 1 a short way outside half the radius length of the rotary table 1, wherein the diameter of the lower dies 8 can be somewhat shorter, for example ¼ shorter than the radius of the rotary table 1.

Thus, it is possible, during processing, for example for a lower die 8 to be located centrally beneath the slide 9 and thus beneath a processing tool connected to the slide 9, such that a highest possible load or force loading can be applied to the workpiece 11 for forming. For example, a first working position 19, located in a comparatively centered manner, for example within the spindle circle 7, with respect to the slide axis $M_S$, can be used for finishing, in particular for a finishing forging operation, while first working positions 19 that are spaced further apart from the slide axis $M_S$ can be used to produce preforms and other upstream forging operations, in which comparatively small forming forces or forging forces arise.

A further lower die 8 is located, as seen in axial projection, outside the cross-sectional area Q of the processing head 16, or of the slide 9, in particular outside the processing region 17, where the workpiece 11 can be removed from the lower die 8 for example in an operation region 6. Respectively, an empty lower die 8 can be fitted in this operation region 6 with a workpiece 11 to be processed, even for example during a forming operation currently taking place another workpiece 11 in a first working position 19. It is also possible for die maintenance, for example for cleaning, lubrication and/or cooling of the lower dies 8, to be carried out on the lower dies 8 in an approach position located in the operation region 6, or outside the processing region 17.

FIG. 3 also illustrates for example that the processing head 16 comprises several upper tool holders 10 with upper dies 22 inserted therein, which cooperate with the lower dies 8 during processing. For this purpose, the upper tool holder 10 and upper dies 22 are arranged analogously to the lower dies 8 along a circular path 7. The number of and configuration of the upper dies 22 can be varied as desired depending on the use purpose and are not limited to the exemplary illustration of this description. With respect to the axial direction, i.e. in the direction of the axis of movement $M_S$, upper and lower dies and approach positions are configured in an aligned manner with respect to one another, wherein immediately adjacent upper and lower dies or approach positions can have an angular spacing of 120 degrees or 60 degrees, respectively.

Figure 4:
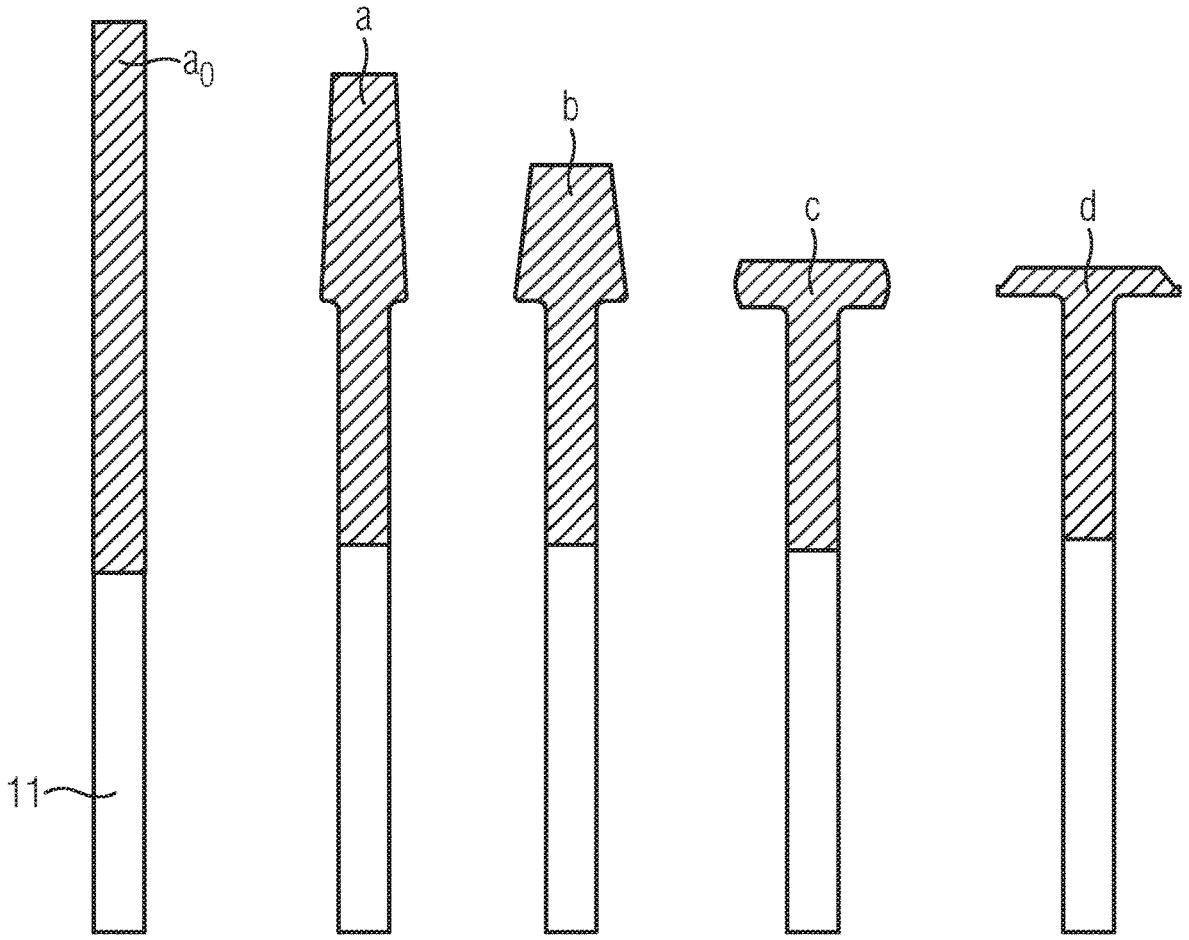
FIG. 4 shows an overview of different stages of a workpiece according to one exemplary embodiment.

FIG. 4 shows an example of a stage sequence in the forming processing of a workpiece 11 to form a flanged shaft. The stage $a_0$ shows the workpiece 11 in the unprocessed starting form. In stages a and b, the workpiece 11 is subjected to a first and a second cone formation process, respectively. In stage c, the workpiece formed into a cone is preformed, and in stage d, the preformed workpiece 11 is forged into the final shape, comprising a shaft with a plate formed thereon.

The upper tool holders 10*a*, 10*b*, 10*c*, and 10*d* arranged in an exemplary manner in FIG. 3 are designed in a manner corresponding to these forming stages and cooperate in a manner corresponding with the lower dies 8 arranged on the rotary table 1, said lower dies 8 receiving the workpieces 11 and being brought into the corresponding approach position 4 by rotating the rotary table 1.

As is apparent in conjunction with FIG. 3, the upper tool holders 10*a* and 10*b* for producing the workpiece stages a and b, respectively, are located in the eccentric region of the processing head 16 and outside the spindle circle 7. Central axes of the tool holders 10*a* and 10*b* intersect the center line of the circular path 2 in the example shown.

During the cone formation processes of the upper tool holders 10*a* and 10*b*, smaller forming forces arise than during the forging of the preform and final form, which can be readily absorbed in the approach positions 4 that are eccentric with respect to the spindle axis $M_S$.

On account of the greater forming forces that arise during preforming and finishing forging, the workpiece stages c and d are positioned at approach positions 4 within or close to the edge of the spindle circle 7, in order to reliably absorb the comparatively greater forming forces. In addition, a gripping tool 10*e* is illustrated in FIG. 3, which is configured to remove, or insert a workpiece 11 into a lower die 8 in the operation region 6.

Figure 5:
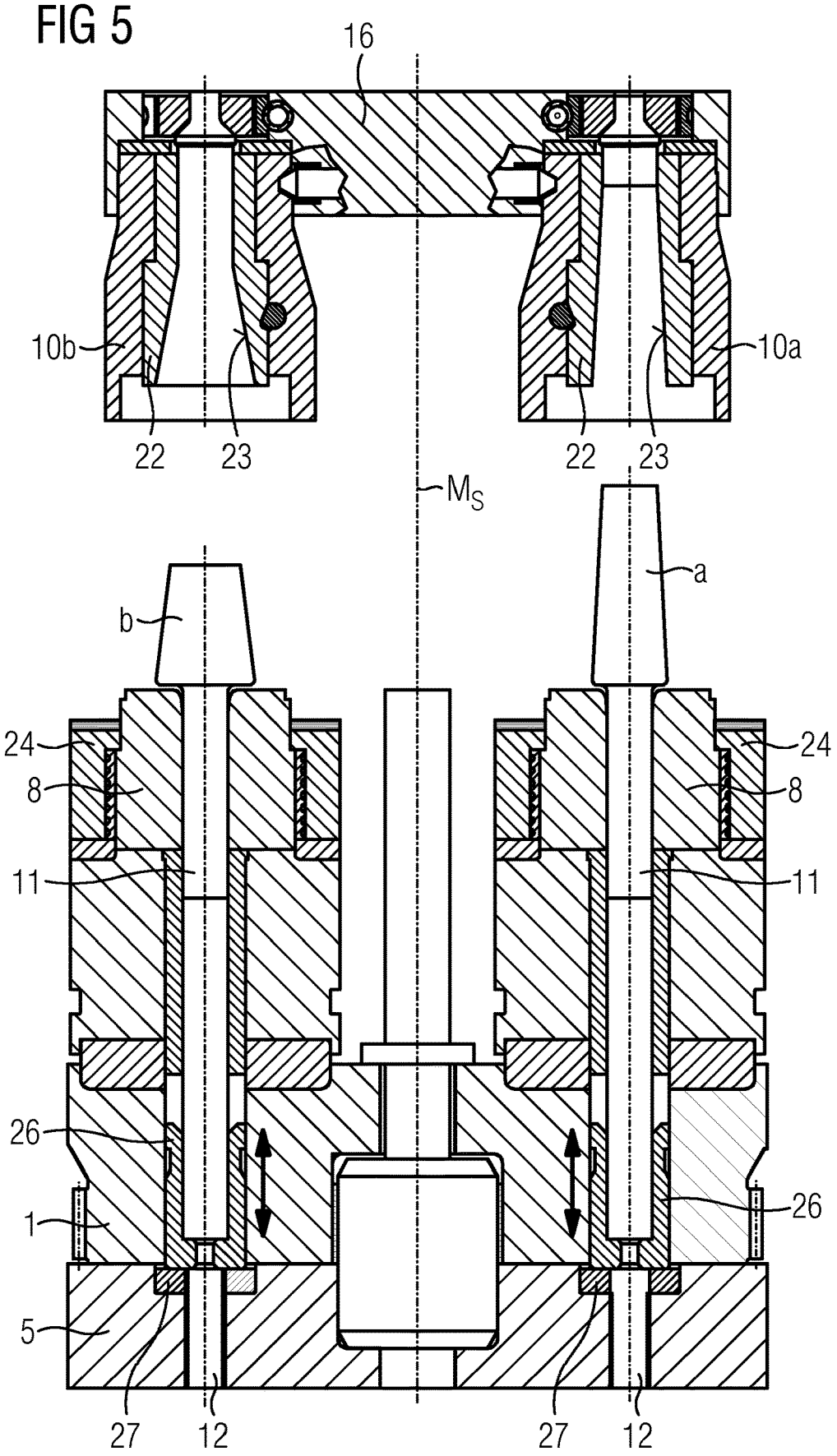
FIG. 5 shows a sectional view of an arrangement with slide and rotary table according to one exemplary embodiment.
Figure 6:
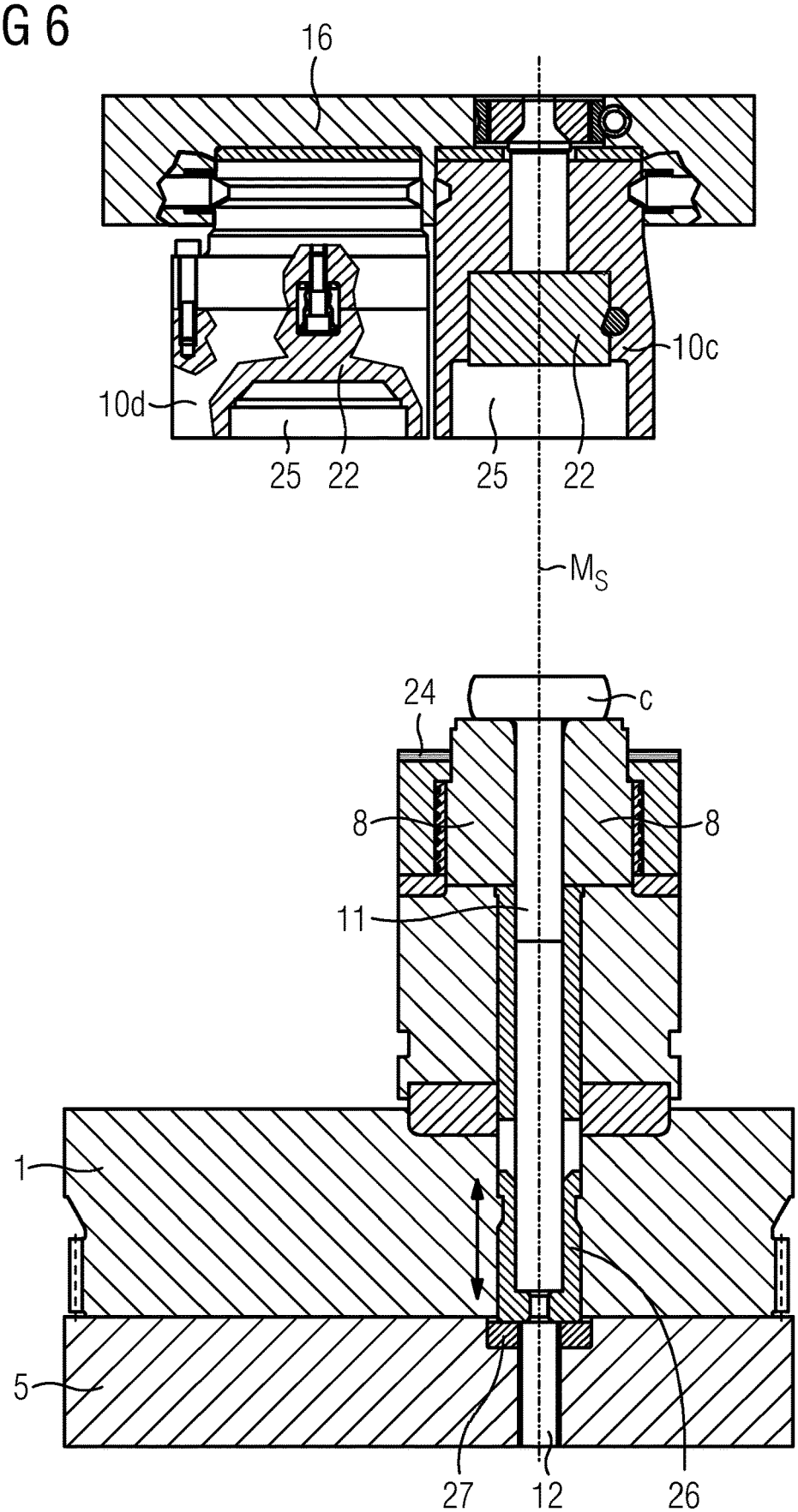
FIG. 6 shows a further sectional view of an arrangement with slide and rotary table according to one exemplary embodiment.
Figure 7:
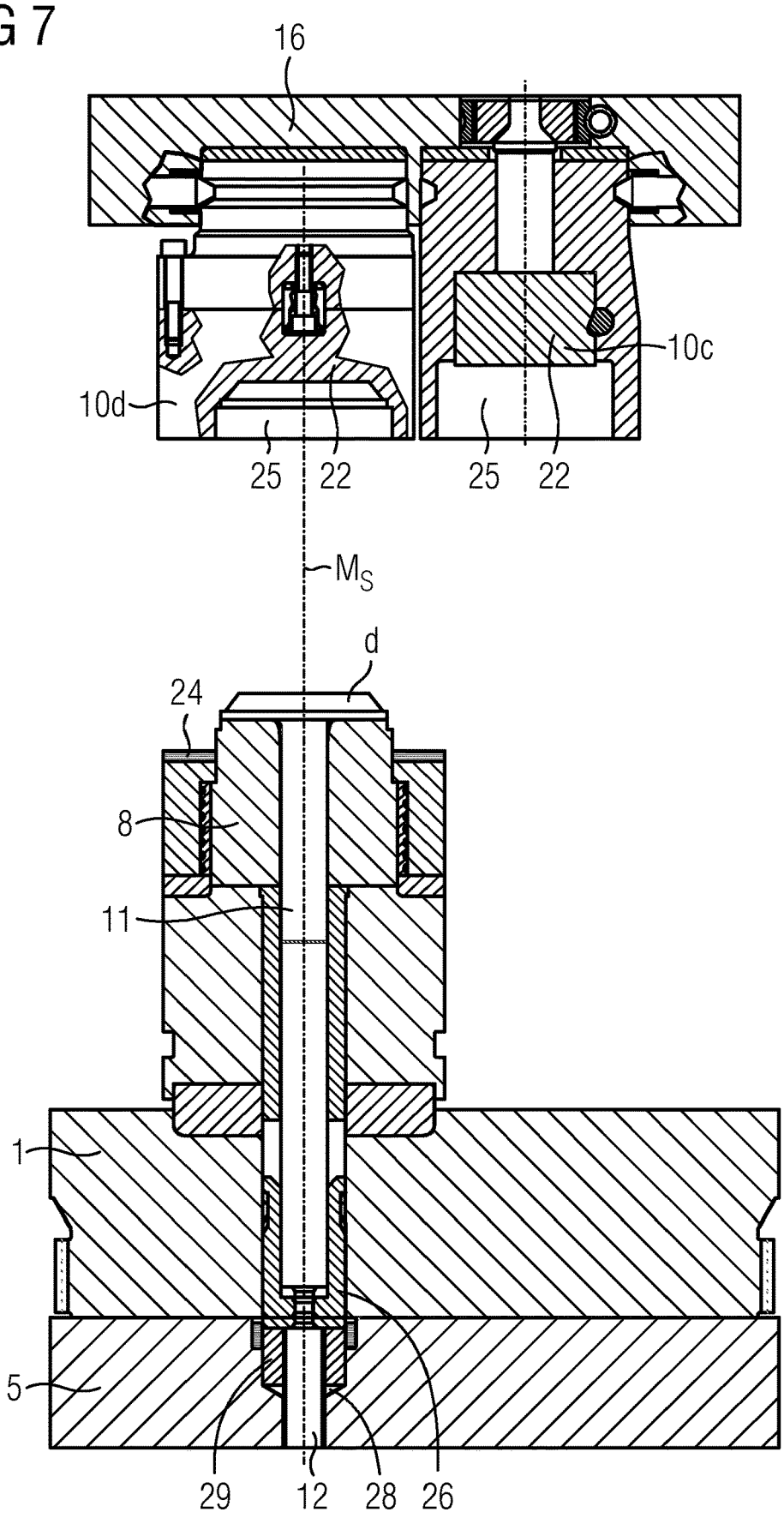
FIG. 7 shows a further sectional view of an arrangement with slide and rotary table according to one exemplary embodiment.

The structure in particular of upper and lower dies according to the exemplary embodiment is illustrated in more detail in FIGS. 5 to 7.

FIG. 5 shows the processing head 16 comprising the upper tool holders 10*a* and 10*b* with upper dies 22, which can have conical faces 23 with different cone angles in the present exemplary embodiment.

The workpieces 11 are inserted into the lower dies 8, wherein the lower dies 8 are clamped in place or secured in tool holders 24, for example chucks or the like, such that the lower dies 8 are supported on the rotary table 1 via the tool holders 24. In this way, the workpieces 11 can be moved, together with a rotation of the rotary table 1, with respect to the lower carrier 5, i.e. the tabletop, into corresponding approach positions 4 under the respective upper dies 22 located in the upper tool holders 10*a* to 10*d*.

The rotary table 1 and the lower carrier 5 have, at respective working positions, or approach positions 4, axial apertures that are arranged centrally in the present example and are oriented parallel to the spindle axis in the respective approach position.

The axial apertures can be provided as a displacement volume, into which excess material can escape during the forming operation when the forming dies are closed. For example, the apertures can be configured such that a part of the workpiece 11, for example a shaft of the workpiece 11 extending from a plate created by the forging operations, can be received therein.

In the lower region of the apertures, specifically in the contact region between the lower carrier 5 and rotary table 1, a bushing 26 has been inserted in at least one of the apertures. A respective bushing 26 is mounted so as to be longitudinally displaceable along the respective aperture, this being indicated by a double arrow in the figures.

At least in the working positions in FIG. 5 and FIG. 6, the bushing 26 is located on a sliding strip 27 let into the lower carrier 5, the bushing 26 being able to slide along said sliding strip 27 for example during a the rotary movement of the rotary table 1.

In the approach position or working position in FIG. 7, in which the workpiece is finished by forging, the sliding strip can be for example interrupted, and the bushing 26 can, with the lifting slide 12 lowered, as shown in FIG. 7, pass into a depression 28 or recess introduced into the lower carrier 5, i.e. the tabletop, or into a receptacle located lower down. For example, the bushing 26 can be coupled to the lifting slide 12 or drive slide 12, such that the bushing 26 can be retracted into the depression 28 therewith.

The bushing 26 can be configured to be displaceable for example by a travel of 10 mm to 20 mm or less, such that, for example during a forming operation, it is possible for material displaced out of the forming volume to be re-fed in the axial direction. The degree of lowering of the bushing 26 can be adapted for example to the requirements, made on a respective workpiece, relating to mass displacement or material flow as a result of a forming operation. The degree of lowering of the bushing 26 can be set for example via a corresponding position of the drive slide 12.

Arranged in the depression 28 is a forging bushing 29. The length of the forging bushing 29 is selected such that that end of the forging bushing 29 that faces the bushing 26 is set back with respect to the edge of the depression 28 in the mounted state, as shown in FIG. 7, such that the offset between the end of the forging bushing 29 and the edge of the depression 28 corresponds to that length by which the bushing passes into the depression 28 during re-feeding. The forging bushing 29 can, as shown in FIG. 7, be arranged coaxially with the axis of movement or spindle axis $M_S$ and concentrically with the drive slide 12. The forging bushing 29 can be inserted interchangeably into the depression, and so forging bushings 29 of different lengths can be inserted, such that the degree of re-feeding can be changed by inserting forging bushings of different lengths into the depression. In the operating state shown in FIG. 7, in which the bushing 26 has passed into the depression 28, the bushing 26 rests on the forging bushing 29. In this regard, the forging bushing 29 can be considered to be a depth stop for the bushing 26 during re-feeding.

As a result of the bushing 26 passing into the depression 28, i.e. as a result of the lowering of the bushing 26 parallel to the forging axis, i.e. axis of movement of the processing head 16, the volume of the aperture in which the bushing 26 is arranged can be increased.

An increase in the volume of the aperture is required or useful in particular when an associated forging or forming operation results or can result in material of the processed workpiece 11 having to escape from the forming zone into the aperture when the forging dies 8, 22 are closed, this being able to occur in the example shown during finishing of the workpiece 11, specifically of the plate of the workpiece 11, by forging in the approach position according to FIG. 7.

Lowering of the bushing 26 is also advantageous in that, in this way, compensation for, for example, tolerance-related differences in length of the raw workpieces ($a_0$) can be achieved.

After the respective forging or forming operation, the bushing 26 can be lifted by moving the lifting slide 12, such that the bottom of the bushing 26 is at the level of the top side of the sliding strip 27 and can slide thereon, such that further rotation of the rotary table is or becomes possible.

Simultaneously with the lifting of the bushing 26, it is possible for the, for example finished forged, workpiece to be lifted, and thus to be brought into a position suitable for removal.

FIG. 6 illustrates the preforming process, and FIG. 7 illustrates finishing by forging for the workpiece stages c and d, respectively, with respective upper and lower dies. To this end, the correspondingly formed upper dies 22 are arranged on the processing head 16 on corresponding upper tool holders 10*c* and 10*d*, in order for it to be possible to process the workpiece 11. The upper die 22 inserted into the upper tool holder 10*c* has a rectangular forming zone 25, and the upper die 22 inserted into the upper tool holder 10*d* has a negative form corresponding to the target form of the workpiece 11 as forming zone 25.

In order to produce the respective stage a, b, c or d, the slide 9 is moved relative to the axis of rotation $M_D$ of the rotary table 1 by means of the operative connection to the spindle (not illustrated), in order, via the upper dies 22, to exert a force on the workpieces 11 which are received in the lower dies 8 and which are positioned on the circular path 2 in an approach position 4 in each case exactly beneath the corresponding upper dies 22 for forming processing.

As can be seen in FIGS. 5 to 7, the workpieces 11 in the respective approach position 4 can be operatively connected to the lifting slide 12. The lifting slide 12 can comprise for example a lifting cylinder and be set up such that targeted lifting of the workpiece 11 is possible. For example, the workpiece 11 can be lifted immediately after forming and be lowered again upon reaching the next forming position. It is also possible for the workpiece 11 to be lifted at least during the movement of the workpiece 11 between the approach positions 4, such that the formed portion is lifted from the lower die 8, with the result that for example the heat input into the lower die 8 can be reduced. The lifting slide 12 can also be used as an ejector rod or slide, in order to lift the workpiece 11 after it has been finished such that it can be removed for example more easily from the lower die 8 in the second working position 20.

The lifting slide 12 is not limited to use for a rotary table 1 arranged in a manner offset in parallel, but can also be used in the same way for a centrically arranged rotary table, i.e. a rotary table the axis of rotation of which coincides with the spindle axis of the spindle press. It is also possible for such a lifting function and lifting device to be used in the case of linear conveying of the workpieces 11, in particular in forming devices without a rotary table.

In configurations, provision can be made for the rotary table 1, together with lower tool receptacles or workpiece receptacles (8), and any lower dies 8 located therein, to be configured to be liftable parallel to the axis of rotation $M_D$ or spindle axis $M_S$.

As a result of the rotary table 1 being lifted with respect for example to the tabletop, i.e. the lower carrier 5, the friction that arises between tabletop and rotary table 1 during rotation of the rotary table 1 can be at least reduced.

In order to lift the rotary table, a correspondingly configured lifting unit can comprise for example one or more rollers accommodated in or on the lower carrier 5, for example the tabletop, said rollers lifting the rotary table 1 with respect to the lower carrier 5 upon actuation. The lifting unit can comprise for example four rollers. A stroke of the lifting unit can be for example 2 mm in configurations.

FIG. 8 to FIG. 13 show a processing sequence in steps I to VI of workpieces 11 according to the exemplary embodiment, in which lower dies 8*a*, 8*b* and 8*c* are arranged along the circular path 2. As already explained, several approach positions 4 are located at the respective positions of the circular arc of the circular sectors 3 of the circular path 2 on the rotary table 1, which can be approached by the lower dies 8*a*, 8*b* and 8*c* by corresponding rotation of the rotary table 1, in order for it to be possible to position them, together with the inserted workpieces 11*a*, 11*b*, 11*c*, beneath an upper die 22 according to FIG. 3 for the purpose of processing.

In this exemplary embodiment, the basic angle of rotation $\alpha$ is 60 degrees. It is now possible to move the rotary table 1 in rotation steps D with a positive or negative multiple of the basic angle of rotation a, in order as a result to bring the lower dies 8*a*, 8*b* and 8*c* into the corresponding processing positions.

A sequence of processing steps is described in the following text for the workpiece 11 that is indicated by a star for easier comprehension in FIG. 8 to FIG. 13.

Figure 8:
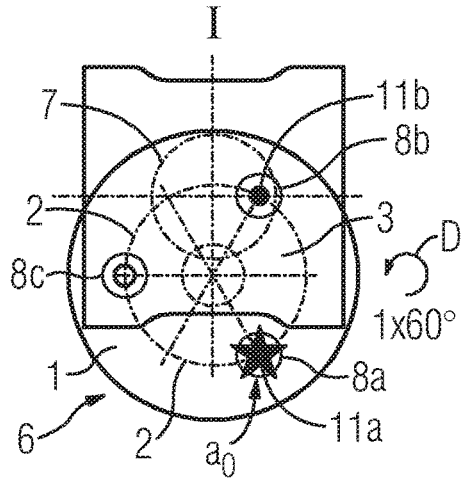
FIG. 8 to FIG. 13 show a processing sequence of workpieces according to one exemplary embodiment.

In step I according to FIG. 8, the lower die 8*a* is in the operating region 6 and a workpiece 11*a* in the state $a_0$ is inserted into said lower die 8*a* by means of the gripping tool 10*e*. Parallel thereto, during this step, a workpiece 11*b* that has already been inserted into the lower die 8*b* and is already in workpiece stage b is subjected to preforming for workpiece stage c. As can be seen, the lower die 8*b* is located substantially within the spindle circle 7, and thus in a central position beneath the slide 9, such that comparatively high forming forces can be applied. The lower die 8*c* remains initially unoccupied.

As the tool for inserting the workpiece, it is possible for example for a robot arm to be provided, which can be moved in an automated manner, and synchronously with the slide 9, or the forming cycle or the forming movements of the slide 9, but independently of the specific movement of the slide 9.

Figure 9:
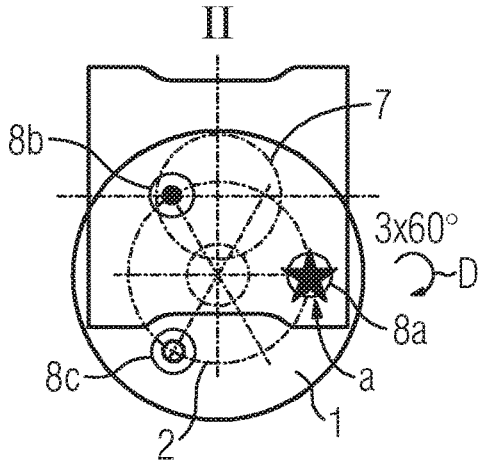

For further processing in step II according to FIG. 9, the rotary table 1 is moved through 1×60 degrees to the left, i.e. +60 degrees, in a rotation step D. The lower die 8*b* is now located in a second approach position 4 substantially within the spindle circle 7 and the inserted workpiece 11*b* is finished by forging into its final form by the upper die 22 of the upper tool holder 10*d* for workpiece stage d. In parallel, the workpiece 11*a* inserted into the lower die 8*a* is subjected to the first cone formation for workpiece stage a by the upper die 22 of the upper tool holder 10*a*. At the same time, die maintenance, for example cooling, lubrication, cleaning etc., can take place at the unoccupied lower die 8*c*.

Figure 10:
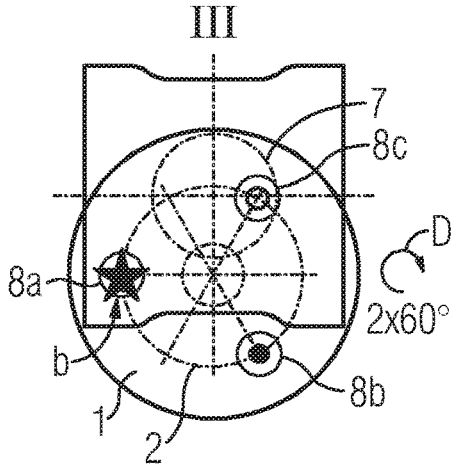

For processing in step III according to FIG. 10, the rotary table 1 is moved through 3×60 degrees to the right, i.e. −180 degrees, in a rotation step D. At this point, a rotation through 3×60 degrees to the left, i.e. +180 degrees, would also be possible for example. The lower die 8*a* is now in an approach position 4 beneath the upper die 22 of the upper tool holder 10*b* for the second cone formation of the workpiece 11*b* for workpiece stage b. The lower die 8*b*, by contrast, is in the operation region 6 for removal of the finished workpiece.

Figure 11:
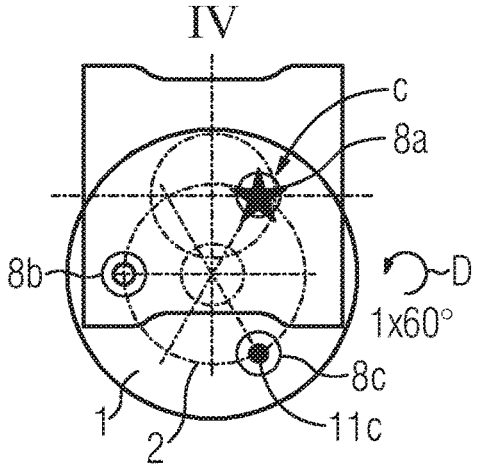
Figure 12:
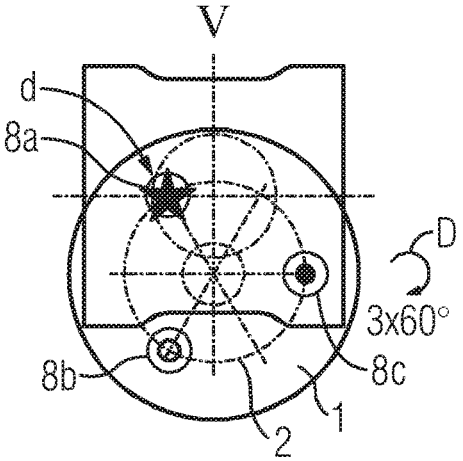
Figure 13:
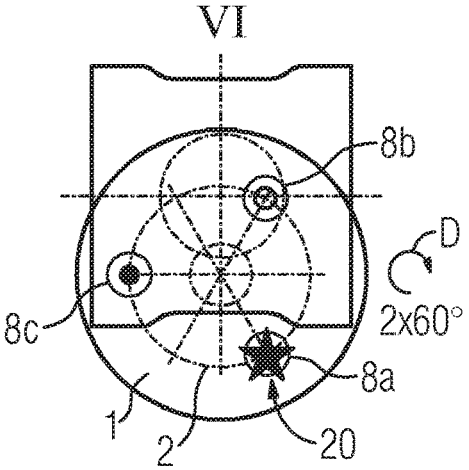

For step IV according to FIG. 11, the rotary table is moved through 2×60 degrees to the right, i.e. −120 degrees, in a rotation step D, such that the previously unoccupied lower die 8*c* can be fitted with an unprocessed workpiece 11*c* by means of the gripping tool 10*e*, while the lower die 8*a* is located within the spindle circle 7 for preforming the inserted workpiece 11.

The lower die 8*b* emptied in step III continues to remain unoccupied in the following steps V and VI, too, in order that die maintenance can be carried out thereon, for example in step V. In the further unoccupied positions, the lower die 8*b* or die can cool down for a subsequent operation.

After preforming for workpiece stage c (cf. FIG. 11), the rotary table is rotated through 1×60 degrees to the left, i.e. +60 degrees, and is thus positioned under the upper die 22 inserted into the upper tool receptacle 10*d*, where the workpiece 11*a* is finished forging by actuating the upper die 22 for workpiece stage d.

After the finishing by forging, a further rotation of the rotary table 1 through 3×60 degrees to the right, i.e. −180 degrees, takes place, with the result that the workpiece 11*a* is brought into the second working position, in which it can be removed from the lower die 8*a*.

In further processing steps, the processing and forming of further workpieces can be repeated analogously to steps I to VI explained above. For example, following removal of the workpiece 11*a* after step VI in FIG. 13, the rotary table can be rotated further through 2×60 degrees to the right, i.e. −120 degrees, and the lower die 8 then located in the second working position 20 can be loaded. In this way, it is possible for the lower die 8*a*, from which a finished forged workpiece 11*a* is removed, first of all to remain unoccupied in order for example for it to be possible to carry out die maintenance thereon.

In configurations and variants of the forming device proposed herein, a diameter of the spindle can be for example 600 mm. The forming device can be designed for example such that the spindle has a maximum stroke of about 550 mm. A carrier plate of the processing head 16 configured to receive upper dies can have a width and/or length of about 1250 mm transversely to the spindle axis $M_S$, wherein a center-to-center distance between adjacent tool receptacles for upper dies can be about 425 mm. A thickness of the lower carrier, i.e. the tabletop, can be about 250 mm for a thickness of the rotary table of about 400 mm.

With the forming device proposed herein and configurations thereof, in particular with the proposed arrangement of the rotary table and/or with the proposed axial drive, it is in particular possible to carry out appropriate die maintenance of each individual lower die 8*a* to 8*c*, while workpieces in the respectively required order can be sufficiently processed or loaded or removed in parallel without any time losses.

LIST OF REFERENCE SIGNS

1 Rotary table
2 Circular path
3 Circular sector
4 Approach position
5 Lower carrier
6 Operation region
7 Spindle circle
8, 8*a*, 8*b*, 8*c* Lower die
9 Slide
10, 10*a* . . . 10*d* Upper tool holder
10*e* Gripping tool
11, 11*a*, 11*b*, 11*c* Workpiece
12 Lifting slide, Drive slide
13 Spindle press
14 Frame
15 Crosshead
16 Processing head
17 Processing region
18 Transverse plane
19 First working position
20 Second working position
21 Drive unit
22 Upper die
23 Conical face
24 Tool holder
25 Forming zone
26 Bushing
27 Sliding strip
28 Depression
29 Forging bushing
A1, A2 Slide axes
$M_D$ Axis of rotation of rotary table
$M_S$ Spindle axis of slide, axis of movement
$\alpha$ Basic angle of rotation
D Rotation step
$a_0$, a . . . d Workpiece stages
I . . . VI Processing steps
$R_D$ Radius of rotary table
$D_S$ Diameter of spindle
Q Cross-sectional area

We claim:

1. A spindle forging press, comprising:

a) a processing head, having several different processing tools, that is guided in a movable manner along a movement axis (MS) for forging at least one workpiece; wherein:

b) the spindle forging press comprises a slide, and the processing head is formed on or attached to the slide, and c) a processing region, located opposite the processing head, having at least one processing station configured for forging of the workpiece, and furthermore comprising:

d) a rotary table having an axis of rotation (MD) parallel to the direction of movement and several lower forging dies that are arranged, with respect to the axis of rotation (MD), in an offset manner with respect to one another in the circumferential direction, wherein:

e) the rotary table is configured and mounted in a rotatable manner such that each of the lower forging dies is transferable by rotation of the rotary table into at least two first working positions for forging workpieces, the two first working positions located within the processing region and into at least one second working position of at least two second working positions which are located at least partially laterally outside a cross-sectional area (Q) of the processing head in axial projection with respect to the axis of movement (MS) and which are configured to facilitate removal of workpieces from the lower forging dies, wherein:

f) an angular spacing of the lower forging dies on the rotary table is such that it is possible for forging steps to be carried out at least partially parallel in time, and wherein g) the forging processing tools are arranged and the spindle forging press is configured to carry out at least two forging steps at least partially parallel in time such that forging operations which require comparatively high forging forces are carried out in the region of the slide center, and forging operations which require comparatively low forging forces are carried out in regions located further away from the slide center.

2. The spindle forging press as claimed in claim 1, wherein the rotary table and processing head are configured such that a fitting opening configured for feeding and/or holding a workpiece at the lower die is located laterally outside the cross-sectional area (Q) of the processing head in the at least one second working position.

3. The spindle forging press as claimed in claim 1, wherein:

the at least one second working position is located furthermore at least partially laterally outside a cross-sectional area (Q) of the slide in axial projection with respect to the axis of movement ($M_S$).

4. The spindle forging press as claimed in claim 2, wherein the cross-sectional area (Q) is at least one of a minimum cross-sectional area of the processing head and/or of the slide coupled thereto; and given by the cross section of the processing head and/or slide at that end of the processing head or slide that faces the processing region.

5. The spindle forging press as claimed in claim 1, comprising:

the rotary table with the lower forging dies;

wherein the lower forging dies are arranged along a circular line on the rotary table of the spindle forging press, such that at least one of:

the lower forging dies are at defined angular spacings from one another with respect to the axis of rotation ($M_D$) of the rotary table, the lower forging dies are at defined angular spacings from one another with respect to the axis of rotation ($M_D$) of the rotary table, wherein an angular spacing between two directly adjacent lower forging dies is 60 degrees, 90 degrees or 120 degrees;

the lower forging dies are arranged in a uniformly distributed manner along the circular line, wherein the axis of rotation ($M_D$) of the rotary table is spaced apart from a slide axis, or spindle axis, and/or central axis of the processing head, said axes extending parallel to the axis of movement, in a direction transverse to the axis of rotation ($M_D$); and the spindle axis or slide axis, as seen in axial projection, is located within that circular line on which the centers of the lower forging dies of the rotary table are located.

6. The spindle forging press as claimed in claim 1, wherein:

at least one of the at least two second working positions is intended and configured to carryout maintenance measures on a lower forging die located in the at least one second working position;

the spindle forging press comprises a maintenance device configured to carryout at least one corresponding maintenance measure; and wherein the maintenance device is configured to carryout at least one maintenance measure selected from the group comprising:

lubrication, cleaning and cooling on the particular lower forging die.

7. The spindle forging press, as claimed in claim 1, comprising:

the rotary table with the lower forging dies and at least one axial drive or at least one lifting unit which is configured to displace the rotary table of the spindle forging press and/or at least one lower die and/or at least one workpiece located in a lower die parallel to the axis of movement ($M_S$) of the processing head of the spindle forging press wherein:

the axial drive or the lifting unit is installed at least partially on or in a forming table, on or in a rotary table receptacle configured for mounting the rotary table on the forming table and/or on or in the rotary table; and the axial drive or the lifting unit comprises at least one drive slide which is mounted so as to be movable in a reciprocating manner and by way of which the rotary table, the lower forging die, the tool and/or the workpiece is movable parallel to the axis of movement ($M_S$).

8. The spindle forging press as claimed in claim 1, comprising:

at least one drive slide;

wherein the rotary table is arranged on a forming table and comprises, on the side facing the rotary table, one or more apertures through which the at least one drive slide can be moved or can engage, such that upon positioning a corresponding workpiece at a working position having a drive slide, the workpiece is moveable relative to the rotary table or the workpiece receptacle.

9. The spindle forging press as claimed in claim 7, wherein:

the axial drive is configured such that, in at least one first working position, the drive slide is lowerable in relation to further working positions, such that, during a first operation assigned to the at least one first working position, it is possible for the workpiece material to expand in the direction of the lowered drive slide; and the drive slide is arranged and configured such that it can be recessed with respect to a workpiece support level, and such that, after corresponding forming and associated expansion of the workpiece material in the direction of the drive slide, the drive slide can be moved in the direction of the rotary table.

10. The spindle forging press as claimed in claim 7 comprising:

the forming table;

wherein:

the rotary table is fastened to the forming table by means of an adapter unit; and the adapter unit is preferably configured and able to be coupled to the forming table and the rotary table such that the axis of rotation ($M_D$) of the rotary table is arranged in a manner spaced apart from the axis of movement ($M_S$).

11. The spindle forging press as claimed in claim 1, comprising:

a forming table assigned to the processing region;

wherein:

the rotary table is fastened to the forming table by means of an adapter unit; and the adapter unit is configured and able to be coupled to the forming table and the rotary table such that the axis of rotation ($M_D$) of the rotary table is arranged in a manner spaced apart from the axis of movement ($M_S$).

12. The spindle forging press as claimed in claim 1, comprising:

a spindle configured to drive the processing head;

wherein:

at least one forging processing tool of the processing head has a central axis extending parallel to the axis of movement ($M_S$), said central axis being located, as seen in axial projection, laterally within, at the edge or immediately next to the spindle cross-sectional area; and as seen in axial projection, an axis connecting the centers of two, in particular adjacent, forging processing tools or forging processing tool receptacles extends through the center of the spindle circle defined in axial projection by the outer circumference of the spindle.

13. The spindle forging press as claimed in claim 1, comprising:

a spindle configured to drive the processing head;

wherein at least one forging processing tool of the processing head has a central axis extending parallel to the axis of movement ($M_S$), said central axis being located, as seen in axial projection, laterally within, at the edge or immediately next to the spindle cross-sectional area.

14. The spindle forging press as claimed in claim 1, comprising:

a spindle configured to drive the processing head;

wherein as seen in axial projection, an axis connecting the centers of two, in particular adjacent, forging processing tools or forging processing tool receptacles extends through the center of the spindle circle defined in axial projection by the outer circumference of the spindle.

15. A method for forging two or more workpieces at least partially parallel in time with a spindle forging press, the spindle forging press comprising a slide and a processing head, having several different forging processing tools, that is guided in a movable manner along a movement axis (MS) for forging at least one workpiece, the processing head being formed on or attached to the slide, the method comprising the following steps:

a) transferring a lower forging die of a rotary table into a second working position of at least two second working positions, located laterally outside a cross-sectional area (Q) of a processing head, by rotating the rotary table about its axis of rotation (MD);

b) inserting a workpiece into the lower forging die located in the second working position of the at least two second working positions;

c) rotating the rotary table about its axis of rotation (MD) such that:

c1) the workpiece is transferred from the second working position into a first one of at least two first working positions; and c2) a further workpiece is transferred into a second one of the at least two first working positions;

d) activating the processing head and forging the workpiece and the further workpiece at least partially parallel in time;

e) transferring the workpiece or the further workpiece into the second working position, or into a further second working position of the at least two second working positions located laterally outside the cross-sectional area of the processing head; and f) removing the workpiece or the further workpiece from the lower forging die located in the second or further second working position, wherein g) the rotating of the rotary table is carried out such that forging operations which require comparatively high forging forces are carried out in the region of the slide center, and forging operations with comparatively low forging forces are carried out in regions further away from the slide center.

16. The method as claimed in claim 15, wherein:

a) the rotary table is rotated synchronously with the activation or deactivation of the processing head, through in each case an integer fraction of a full angle, and wherein the direction of rotation of the rotary table during the processing cycle of the workpiece is reversed at least once; and b) at least one of the lower forging die is unoccupied during a complete operating cycle for producing the workpiece.

17. The method as claimed in claim 15, wherein:

a) the rotary table is rotated synchronously with the activation or deactivation of the processing head, through in each case an integer fraction of a full angle, and wherein the direction of rotation of the rotary table during the processing cycle of the workpiece is reversed at least once.

18. The method as claimed in claim 15, wherein:

a) at least one of the lower forging die is unoccupied during a complete operating cycle for producing the workpiece.

19. The method as claimed in claim 15, wherein:

the lower forging dies are arranged, with respect to the axis of rotation ($M_D$), in a manner offset through an angle of 120 degrees with respect to one another, and a lower forging die fitted with a workpiece is transferred, starting from the second working position for the forming processing of the workpiece, successively into a plurality of first working positions that are arranged, with respect to the axis of rotation ($M_D$), in a manner offset through an angle of 60 degrees with respect to one another;

four first working positions that are arranged in an offset manner with respect to one another are passed through in accordance with a movement pattern, according to which, starting from the second working position, by rotating the rotary table, the workpiece receptacle is rotated through +60 degrees, +180 degrees or −180 degrees, −120 degrees and +60 degrees, and is subsequently transferred back into the second working position for removing the workpiece by rotation through an angle of −180 degrees or +180 degrees.

20. The method as claimed in claim 15, wherein:

at least one of the at least two second working positions is intended to carryout maintenance measures on a lower forging die located in the at least one second working position;

the method furthermore comprises the carrying out of a maintenance measure on a lower forging die located in the at least one second working position; and the maintenance measure selected from the group comprising: lubrication, cleaning and cooling of the lower forging die.

21. The method as claimed in claim 15, wherein the rotary table and/or the lower forging die together with the workpiece or only the workpiece is/are lifted or lowered parallel to the axis of movement ($M_S$) during at least one processing step and/or at least between two processing steps.

22. A method for the forming process of a workpiece with a spindle press, the spindle forging press comprising a slide and a processing head, having several different forging processing tools, that is guided in a movable manner along a movement axis (MS) for forging at least one workpiece, the processing head being formed on or attached to the slide, the method comprising the following steps:

a) transferring a lower die of a rotary table into a second working position of at least two second working positions, located laterally outside a cross-sectional area (Q) of a processing head, by rotating the rotary table about its axis of rotation (MD);

b) inserting a workpiece into the lower die located in the second working position of the at least two second working positions;

c) rotating the rotary table about its axis of rotation (MD) such that the workpiece is transferred from the second working position into at least one first working position;

d) activating the processing head for the forming processing of the workpiece;

e) optionally rotating the rotary table about its axis of rotation (MD) and transferring the workpiece into a further first working position;

f) transferring the workpiece into the second working position, or into a further second working position of the at least two second working positions located laterally outside the cross-sectional area of the processing head; and g) removing the workpiece from the lower die located in the second or further second working position, wherein h) forming operations which require comparatively high forming forces are carried out in the region of a slide center, and forming operations with comparatively low forming forces are carried out in regions further away from the slide center, wherein the lower dies arranged, with respect to the axis of rotation (MD), in a manner offset through an angle of 120 degrees with respect to one another, and a lower die fitted with a workpiece is transferred, starting from the second working position for the forming processing of the workpiece, successively into a plurality of first working positions that are arranged, with respect to the axis of rotation (MD), in a manner offset through an angle of 60 degrees with respect to one another, and passing the workpiece through four first working positions that are arranged in an offset manner with respect to one another is in accordance with a movement pattern, according to which, starting from the second working position, by rotating the rotary table, the workpiece receptacle is rotated through +60 degrees, +180 degrees or −180 degrees, −120 degrees and +60 degrees, and is subsequently transferred back into the second working position for removing the workpiece by rotation through an angle of −180 degrees or +180 degrees.

23. The method as claimed in claim 22, wherein:

at least one of the lower die is unoccupied during a complete operating cycle for producing the workpiece.

24. The method as claimed in claim 22, wherein:

the rotary table is rotated synchronously with the activation or deactivation of the processing head, and wherein the direction of rotation of the rotary table during the processing cycle of the workpiece is reversed at least once.

25. The method as claimed in claim 22, wherein:

at least one of the at least two second working positions is intended to carryout maintenance measures on a lower die located in the at least one second working position;

the method furthermore comprises the carrying out of a maintenance measure on a lower die located in the at least one second working position; and the maintenance measure being selected from the group comprising:

lubrication, cleaning, and cooling of the lower die.

26. The method as claimed in claim 22, wherein the rotary table and/or the lower die together with the workpiece or only the workpiece is/are lifted or lowered parallel to the axis of movement (Ms) during at least one processing step and/or at least between two processing steps.

* * * * *